United States Patent [19]

Parker

[11] 4,029,939

[45] June 14, 1977

[54] APPARATUS FOR HEAT TREATMENT OF STRAND MATERIAL

[75] Inventor: Walter Parker, Wilmslow, England

[73] Assignee: Ernest Scragg & Sons Limited, Macclesfield, England

[22] Filed: May 21, 1975

[21] Appl. No.: 579,500

[30] Foreign Application Priority Data

May 23, 1974 United Kingdom ..... 23007/74

[52] U.S. Cl. ..... 219/388; 28/62; 57/34 HS; 165/107

[51] Int. Cl.[2] ..... F27D 11/00; F28D 15/00

[58] Field of Search ..... 165/109, 76, 105, 107; 28/62; 57/34 HS; 219/388 S

[56] References Cited

UNITED STATES PATENTS

| | | | |
|---|---|---|---|
| 2,628,081 | 2/1953 | Laird | 165/109 |
| 3,225,454 | 12/1965 | Joch et al. | 28/62 |
| 3,230,637 | 1/1966 | Taylor, Jr. | 28/62 |
| 3,395,433 | 8/1968 | Kodaira et al. | 165/105 |
| 3,551,971 | 1/1971 | Lehner | 219/388 S |
| 3,554,503 | 1/1971 | Borner | 57/34 HS |
| 3,770,051 | 11/1973 | Kodaira | 219/388 S |
| 3,879,599 | 4/1975 | Kodaira | 219/388 S |
| 3,891,395 | 6/1975 | Winkler | 165/109 |
| 3,902,046 | 8/1975 | Oi | 219/388 S |

*Primary Examiner*—C. J. Husar
*Attorney, Agent, or Firm*—Michael J. Striker

[57] ABSTRACT

Apparatus for heating strand material comprises two tubular liquid containing manifolds in liquid connection with a plurality of elongate tubular strand heater members and a tubular housing which contains a liquid heating unit and a liquid circulation pump. The tubular housing is connected by its ends to the central regions of the two manifolds and each heater member is connected at each end to a manifold by a short tube. The circulation pump comprises a rotary axial flow vaned impeller and an expansion tank is mounted above the tubular housing.

12 Claims, 3 Drawing Figures

FIG.2.
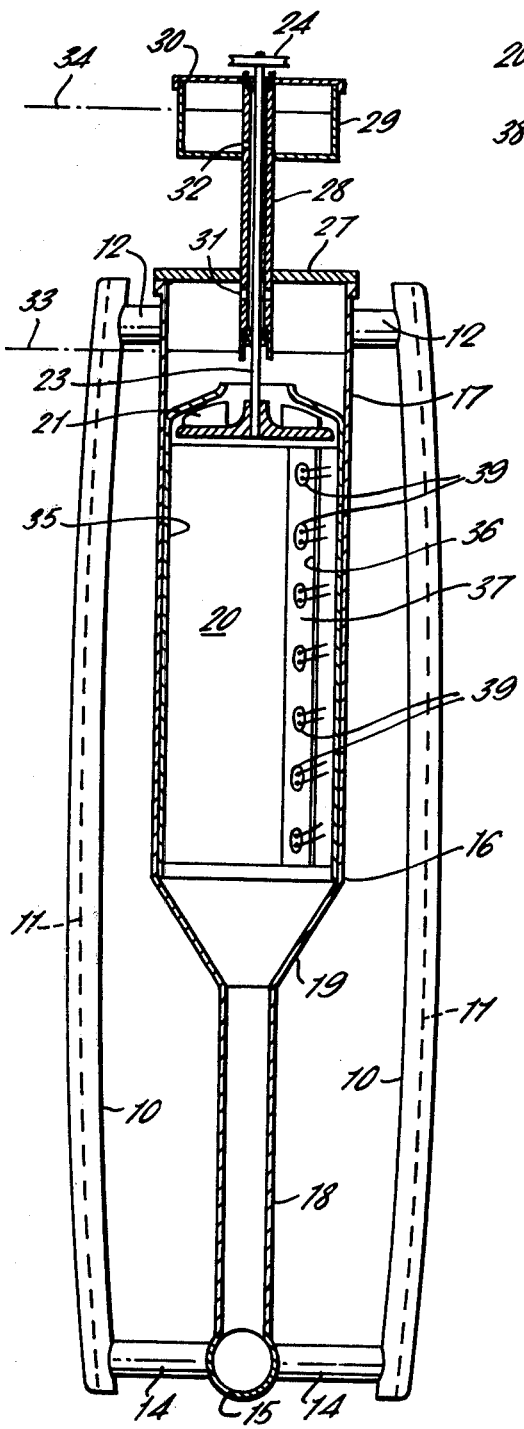
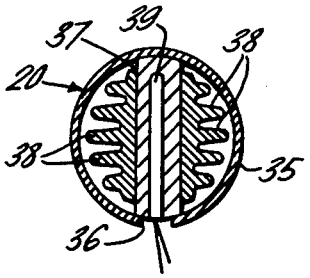
FIG.3.

APPARATUS FOR HEAT TREATMENT OF STRAND MATERIAL

This invention relates to apparatus for heat treatment of travelling strand material, for example yarn of thermoplastic material undergoing a texturing process such as false twist crimping which involves heating the yarn to a softened condition, although the apparatus of the invention is not so limited as to its use but can be used for heating any travelling strand material for any purpose.

It is already known to transfer heat to running thermoplastic yarns by heating apparatus which employs liquid such as non-oxidising oil as the heat transfer medium, the liquid itself being heated as by one or more electrical heating units and the liquid being circulated through the heating apparatus by a pump, and it is to improved heating apparatus of this kind that the present invention relates.

According to the present invention, apparatus of the kind referred to, for heat treatment of strand material, comprises two spaced apart tubular liquid manifolds which are common to multiple elongate tubular strand heater members each extending between and in liquid flow connection with the two manifolds at the end regions of the strand heater members, the two manifolds being connected by a common tubular housing provided with a heating unit for the liquid and a liquid circulation pump.

Preferably the tubular manifolds are connected with the top and bottom regions of a central tubular housing and each heater member is connected by a short tube at its upper end to the top tubular manifold and by a short tube at its bottom end to the bottom tubular manifold.

An embodiment of the invention will now be described with reference to the accompanying diagrammatic drawings in which:

FIG. 2 is an end view partially in cross-section of the apparatus of FIG. 1.

FIG. 3 is a fragmentary sectional plan view showing some constructional details of the heating unit and tubular housing.

Figure 1:
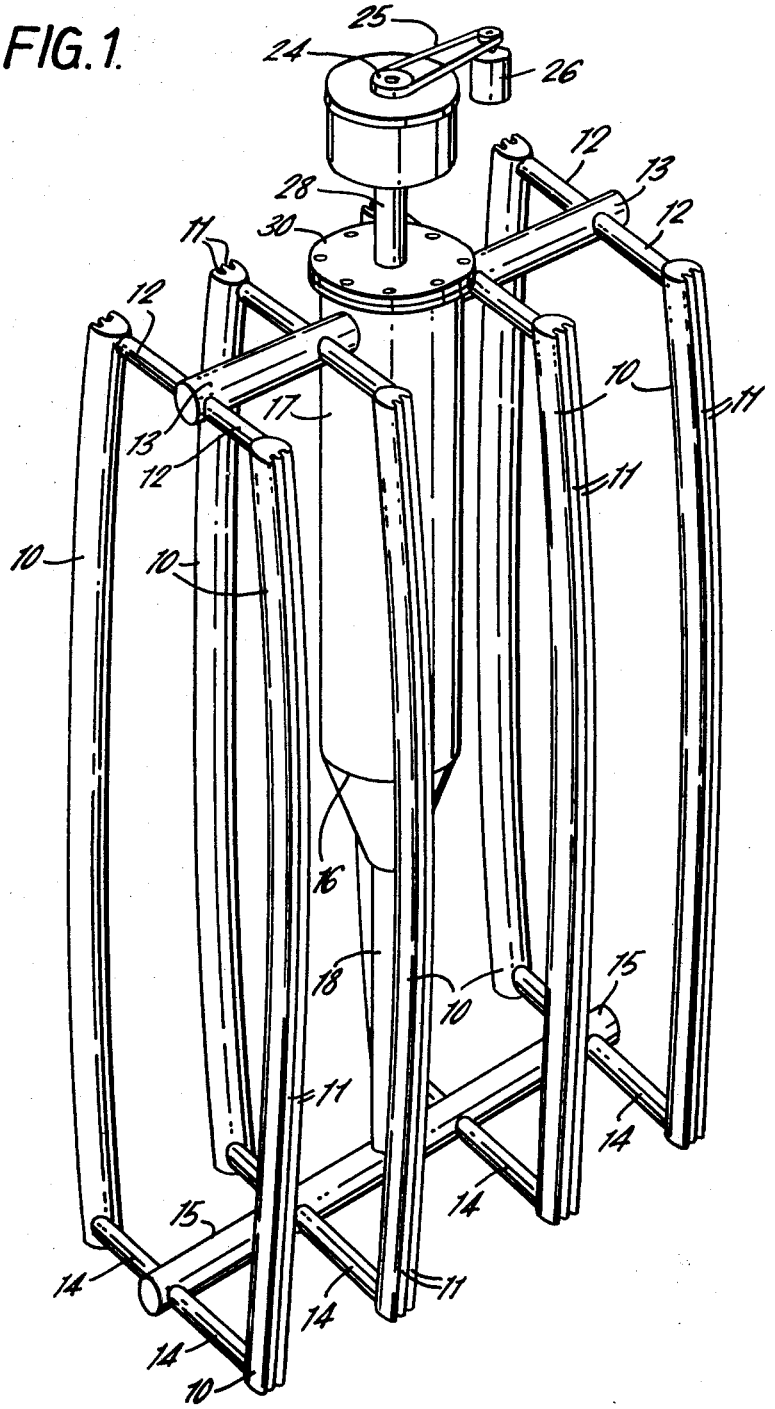
FIG. 1 is a perspective view of heating apparatus according to the invention.

Referring to FIG. 1 of the drawings, there is illustrated heating apparatus in the form of a unit or module for providing heating of multiple running strands (not shown) undergoing processing at a related number of processing stations (not shown) of a textile machine such as a false twist crimping machine (not shown).

FIG. 1 shows eight elongate tubular strand heater members 10, each with two side-by-side lengthwise grooves 11 in each of which a strand runs to be contact-heated, as for setting false twist in a strand of thermoplastic material and thereby crimping it. Each heater member 10 is connected by a short tube 12 at its upper end to a common top tubular liquid manifold 13, and by a short tube 14 at its bottom end to a common bottom tubular liquid manifold 15. The strand heater members 10 are thus in liquid flow connection with the two manifolds 13 and 15 at the end regions of the heater members.

The manifolds 13 and 15 are connected with the respective top and bottom end regions of a central tubular housing 16 which also connects them together since it is common to both.

An upper portion 17 of the housing 16 is of larger diameter than a lower portion 18 and these two portions are joined by a tapering intermediate portion 19. The upper portion 17, as seen in FIGS. 2 and 3, is provided with a heating unit 20, above which is located a pump incorporating a rotary axialflow vaned impeller 21 carried by a vertical drive shaft 23 with a drive pulley 24 at its upper end. As seen in FIG. 1, the drive pulley 24 is connected by a belt 25 to a drive motor 26.

A removable top cover 27 for the upper portion 17 of the housing carries a vertical sleeve 28 in which the pump impeller shaft 23 is journalled, and at the upper end of the sleeve is mounted an expansion tank 29 with a removable cover 30. The sleeve bore is in communication with the interior of the housing via a set of holes 31, and also with the expansion tank via a similar set of holes 32.

The system is charged with heat-exchange liquid such as non-oxidising oil, the level of which when cold is indicated at 33, and the level when hot being indicated at 34, i.e., in the expansion tank.

Details of the construction of the heating unit 20 can be seen in FIGS. 2 and 3. It consists of a cylindrical metal jacket 35 with a lengthwise slot 36 which is in register with a similar slot (not shown) in the upper portion 17 of the housing. The jacket 35 makes a liquid-tight fit with the inner wall of the upper portion 17 of the housing, and within the jacket is mounted a heater block 37 which can be of any suitable material capable of acting as a heat sink and heat-exchanger, for example aluminium, and as shown in FIG. 3 the block 37 is formed to provide lengthwise flow passages for the heat-exchange liquid by providing the block with spaced ribs 38 along its length. Obviously the passages could be otherwise formed, as by spiral ribs and grooves.

A portion of the heater block is exposed to the exterior of the top portion 17 of the housing through the slot 36 in the jacket and the registering slot in the housing, and through these slots thermostatically controlled heater elements 39 are removably inserted in bores in the heater block to heat it to a predetermined temperature.

In operation the pump impeller 21 circulates the heat-exchange liquid in the housing 16 downwardly over the heater block 37 and into the bottom manifold 15, from which the liquid flows in parallel upwardly through the strand heater members 10 and into the top manifold 13, from which it returns to the top of the housing for re-circulation and re-heating. The housing, the manifolds, and the strand heater members are preferably suitably lagged to minimise heat loss.

The pump impeller need not run at high speeds, but only fast enough to circulate the liquid at a rate sufficient to maintain a temperature drop of the order of about 5° C as between the bottom and top ends of the heater members 10.

The construction is preferably such that the pump impeller unit and heater unit are readily removable from the top of the housing 16 for inspection, maintenance, and repair.

The drawing illustrate heating apparatus in which eight heater member 10 are arranged four on each opposite side of the apparatus and associated with one tubular housing for a single pump and heater unit, but it will be appreciated that there may be fewer on more heater members, for example twelve heater members forming a unit or module of bay length for a yarn crimping machine.

What is claimed is:

1. Apparatus for heating strand material comprising two tubular liquid containing manifolds, a plurality of elongate tubular strand heater members each extending between and in liquid flow connection with the two manifolds, a tubular housing also connected to the two manifolds, a liquid heating unit and a liquid circulation pump, the heating unit and circulation pump being contained within the tubular housing.

2. Apparatus according to claim 1 wherein the tubular housing is connected by its ends to the central regions of the two manifolds.

3. Apparatus according to claim 1 wherein one end of each strand heater member is connected to one of the manifolds by means of a short tube and the other end of each strand heater member is connected to the other of the manifolds by means of another short tube.

4. Apparatus according to claim 1 wherein the liquid circulation pump comprises a rotary axial flow vaned impeller.

5. Apparatus according to claim 1 further comprising an expansion tank mounted above and connected to the tubular housing.

6. Apparatus for heating strand material, comprising two spaced tubular liquid-containing manifolds; a plurality of elongated tubular strand-heating members each extending between and communicating with said manifolds; a tubular housing having an interior also communicating with said manifolds and an opening provided with a removable cover; means connecting said housing to said manifolds and communicating said interior with said manifolds; and a liquid-heating unit and a liquid-circulating means, both located in said interior of said tubular housing for heating the liquid therein and circulating the heated liquid through said manifolds and said strand-heating members, said heating unit and circulating means being mounted in said housing for removal through said opening without requiring disconnecting of said housing from said manifolds.

7. Apparatus as defined in claim 6, said housing being upright and having an upper end portion provided with said opening, and said circulating means being mounted in said interior intermediate said opening and said heating unit.

8. Apparatus as defined in claim 7, said circulating means including a rotary shaft mounted on said cover and extending through the same from the exterior of said housing to the interior thereof, an impeller carried by said shaft in said interior, and motion-transmitting means carried by said shaft at the exterior of said housing, said circulating means thus being removable from said housing together with and in response to removal of said cover from said opening.

9. Apparatus as defined in claim 8, said cover comprising a tube extending therethrough from said exterior to said interior and communicating with the latter, said shaft extending axially through said tube and having a portion extending beyond an upper end thereof and provided with said motion-transmitting means.

10. Apparatus as defined in claim 9; and further comprising an expansion tank for the liquid mounted on said tube at the exterior of said housing and communicating with the interior of said tube and via the same with said interior of said housing.

11. Apparatus for heating strand material, comprising two tubular liquid-containing manifolds spaced from one another in a substantially vertical direction; a plurality of elongated tubular strand heating members each extending between the upper and the lower of said manifolds and communicating with the same; a tubular housing having an interior also communicating with said upper and said lower manifolds; and a liquid heating unit and a liquid-circulating means, both located in said interior of said tubular housing for heating the liquid therein and circulating the heated liquid through said manifolds and said strand-heating members.

12. Apparatus as defined in claim 11; further comprising means connecting said housing to said manifolds and communicating said interior with said manifolds.

* * * * *